US005483267A

United States Patent [19]

Nemura et al.

[11] Patent Number: 5,483,267

[45] Date of Patent: Jan. 9, 1996

[54] INK JET RECORDING APPARATUS

[75] Inventors: Masaharu Nemura; Tomohiro Aoki, both of Yokohama; Yasushi Murayama, Tokyo; Takashi Uchida, Yokohama; Tohru Kobayashi, Tokyo; Masatoshi Ikkatai, Kawasaki; Tatsuo Mitomi; Yasuyuki Takanaka, both of Yokohama, all of Japan

[73] Assignee: Canon Kabushiki Kaisha, Tokyo, Japan

[21] Appl. No.: 352,717

[22] Filed: Dec. 5, 1994

Related U.S. Application Data

[63] Continuation of Ser. No. 873,013, Apr. 24, 1992, abandoned.

[30] Foreign Application Priority Data

Apr. 26, 1991 [JP] Japan ..... 3-097218

[51] Int. Cl.[6] ..... B41J 2/165

[52] U.S. Cl. ..... 347/32; 347/35; 347/42

[58] Field of Search ..... 347/22, 23, 29, 347/30, 32, 35, 42, 43

[56] References Cited

U.S. PATENT DOCUMENTS

| | | | |
|---|---|---|---|
| 4,313,124 | 1/1982 | Hara | 347/57 |
| 4,345,262 | 8/1982 | Shirato et al. | 347/10 |
| 4,437,105 | 3/1984 | Mrazek et al. | 347/29 |
| 4,459,600 | 7/1984 | Sato et al. | 347/47 |
| 4,463,359 | 7/1984 | Ayata et al. | 347/56 |
| 4,558,333 | 12/1985 | Sugitani et al. | 347/65 |
| 4,723,129 | 2/1988 | Endo et al. | 347/56 |
| 4,740,796 | 4/1988 | Endo et al. | 347/56 |
| 4,931,955 | 6/1990 | Okabayashi et al. | 347/23 |
| 4,947,191 | 8/1990 | Nozawa et al. | 347/30 |
| 5,055,861 | 10/1991 | Murayama et al. | 347/29 |
| 5,225,853 | 7/1993 | Kobayashi et al. | 347/33 |

FOREIGN PATENT DOCUMENTS

| | | |
|---|---|---|
| 0445526 | 9/1991 | European Pat. Off. . |
| 54-56847 | 5/1979 | Japan . |
| 59-123670 | 7/1984 | Japan . |
| 59-138461 | 8/1984 | Japan . |
| 60-71260 | 4/1985 | Japan . |
| 3-227654 | 10/1991 | Japan . |

*Primary Examiner*—Benjamin R. Fuller
*Assistant Examiner*—John E. Barlow, Jr.
*Attorney, Agent, or Firm*—Fitzpatrick, Cella, Harper & Scinto

[57] ABSTRACT

An ink jet recording apparatus for recording information by ejecting ink fluid onto a recording medium has a recording head, a head drive part, a capping unit, a first moving unit, an ink receiver and a second moving unit. The recording head having an orifice ejects an ink fluid from the orifice. The head drive part drives the recording head to eject an ink fluid. The capping part covers up the orifice of the recording head, the part being installed so as to be able to move relative to the recording head. The first moving unit moves the capping unit and the recording head relative to each other. The ink receiver receives an ink fluid ejected from the recording head. The second moving unit moves the ink receiver and the recording head relative to each other and enables this movement independent of the movement established by the first moving unit.

14 Claims, 5 Drawing Sheets

INK JET RECORDING APPARATUS

This application is a continuation of application Ser. No. 07/873,013 filed Apr. 24, 1992, now abandoned.

BACKGROUND OF THE INVENTION

1. Field of the Invention

The present invention relates to an ink jet recording apparatus, and particularly to an ink jet recording apparatus used as an apparatus for outputting characters and images in facsimiles, copy machines, printers and others.

2. Description of the Related Art

Non-impact recording methods have been remarkably put into practical use on the basis that the level of noise generated by recording operations could be kept so low that their existence could be neglected. Among several kinds of non-impact recording methods, ink jet recording method is one of the most advantageous methods where general purpose paper sheets can be used for recording without processing their own material and/or coating specific synthetic materials on their surfaces.

In a recording head used in the ink jet recording apparatus, in general, there exists an ink fluid path having an orifice at one open end, an energy supplying part formed in a part of this ink fluid path and an energy generation means for generating energy to be supplied to ink fluid in the energy supplying part so as to eject ink fluid.

As for energy generation means, what can be selected are electromechanical conversion devices such as piezo device, electromagnetic wave energy generation means such as lasers which apply electromagnetic waves to the ink fluid for the generation of heat and eject the ink fluid by kinetic energy accompanied by the heat generation, and electrothermal conversion devices discharging the ink fluid by heating the ink fluid with heating resistors.

Among these devices and means, recording heads using electro-thermal conversion devices as energy generation means can be formed with orifices arranged in a high density array, and therefore, with these devices, a high resolution recording can be achieved. In addition, the size of the finished recording head can be small and recent technical advantages in semiconductor devices and their fabricating processing technologies can be fully used in order to develop recording heads in large-scale and two-dimensional configurations. By using electro-thermal conversion devices, the fabrication in large amounts and with low cost of recording heads having a relatively large number of orifices formed with a high density and an ink jet recording apparatus with such recording heads are feasible.

In ink jet recording heads, there may be cases that the viscosity of ink fluids may increase due to evaporation of water or other solvents in ink fluids especially when a long period of time has passed since the recording operation was terminated or when some orifices are not used for recording operations owing to characteristic patterns of the recorded images. As a result, the amount of ink fluid ejected from such an orifice may be lowered and the ejecting direction of ink fluids may become unstable, and in the worse cases, the ejection operation may fail due to plugging of the orifice. One of the structures used in order to prevent such ejection operation failures is a capping mechanism having a cap for covering the orifice of the recording head. With this capping mechanism, by capping the recording head not used in the recording operation, the orifice is shielded from the atmosphere and the increase of the viscosity of ink fluids in the orifice can be prevented. However, as for an orifice which is not used for ejecting ink fluids during the recording operation, even in the recording operation, the ink fluid may become more viscous which may lead to the ink fluid ejection failure. Such ink fluid ejection failure can be prevented by a structure where an ink fluid ejection operation is performed independently of recording operations. This ink fluid ejection operation is called idle ejection in the following description.

In the idle ejection operation, it is general that a storage part for storing the ink fluid ejected from the orifice is provided. One embodiment of the storage part is an ink absorber made of porous materials for absorbing the waste ink fluid ejected from the orifice. The ink absorber is placed in front of the orifice and linked to the waste ink fluid storage tank installed in a designated position for receiving and storing waste ink fluids through flexible tubes. In many cases, the above described capping means has an ink absorber inside.

One embodiment of idle ejection operations using the cap having an ink absorber is disclosed in Japanese Patent Application Laying-open No. 227654/1991 which is published after the priority date of this application. The recording head disclosed in this gazette has orifices along the range corresponding to a width of the recording sheet being transported in the apparatus, and the recording operation is performed by moving the recording sheet relative to the recording head which are fixed in the apparatus. The idle ejection operations in this recording head are performed in the following manner.

In the case where the idle ejection is performed during the recording operations, after the recording head unit is moved upward, the cap unit is moved in the horizontal direction to the original position of the recording head. Next, the recording head unit is moved downward so that the cap unit may contact the recording head unit and the ink fluids in the recording head is ejected to the ink absorber in the cap by the idle ejection operation. After completing the idle ejection operation, the recording head unit is moved backward to the original position for the recording operation.

The above-mentioned ejection operation is basically applicable to the case that the recording head moves relative to the recording sheet in the recording operation. That is, the recording head unit is moved to the position where the cap unit is fixed and the recording head unit and the cap unit are caused to contact each other for the capping operation. While the cap unit contacts the recording head, the idle ejection operation continues, and after completing the idle ejection operation, the recording head unit is moved backward to the recording positions.

In either of the above-mentioned methods, the idle ejection operation is often performed just before starting the recording operation after waiting for the recording operation, with the recording head being capped as well as concurrently during the recording operation.

The above described idle ejection operation accompanies the movement of the recording head unit and the cap unit toward the positions for the idle ejection operation and the movement of the recording head unit and the cap unit back to the positions for the recording operation, and the time spent accomplishing these movements is one of major factors reducing the throughput of the ink jet recording apparatus.

SUMMARY OF THE INVENTION

An object of the present invention is to provide an ink jet recording apparatus enabling increase in the throughput by reducing the time spent performing the idle ejection operation.

In a first aspect of the present invention, an ink jet recording apparatus for recording an information by ejecting an ink fluid onto a recording medium comprises:

a recording head having an orifice for ejecting an ink fluid from the orifice;

a head drive means for driving the recording head to eject an ink fluid;

a capping means for covering up the orifice of the recording head, the means being installed so as to be able to move relative to the recording head;

a first moving means for moving the capping means and the recording head relative to each other;

an ink receiving means for receiving an ink fluid ejected from the recording head; and a second moving means for moving the ink receiving means and the recording head relative to each other and for enabling the movement independent of the movement established by the first moving means.

Here, the recording head may have a plurality of orifices in an array along a range corresponding to a width of a recording sheet fed to the apparatus; and the ink receiving means may have a body, a length of which is at least larger than the range along which the plurality of orifices are disposed in an array.

A plurality of the recording heads may be formed as a unit defined in a parallel state.

The ink receiving means may have an ink absorber for absorbing ejected ink fluid from the recording head.

The recording head may have an electro-thermal conversion element generating thermal energy used for ejection energy to eject an ink fluid.

In a second aspect of the present invention, an ink jet recording apparatus for recording an information by ejecting an ink fluid onto a recording medium comprises:

a recording head having an orifice for ejecting an ink fluid from the orifice;

a head drive means for driving the recording head to eject an ink fluid;

a capping means for covering up the orifice of the recording head, the means being installed so as to be able to move in relative to the recording head;

a first moving means for moving the capping means and the recording head in relative to each other;

an ink receiving means for receiving an ink fluid ejected from the recording head;

a second moving means for moving the ink receiving means and the recording head in relative to each other and for enabling the movement independent of the movement established by the first transport means; and a control means for controlling the first moving means, the second moving means and the head drive means so as to permit the recording head to eject ink fluid toward the ink receiving means while moving relatively the recording head, the capping means and the ink receiving means.

Here, the control means may control the first moving means and the second moving means so as to move the capping means and the ink receiving means together from a state that the orifice of the recording head is covered by the capping means, and may control the head drive means to drive the recording head to eject ink fluid toward the ink receiving means during the movement, and the recording head may reach a recording position by the movement.

A plurality of the recording heads may be formed as a unit defined in a parallel state.

The ink receiving means may have an ink absorber for absorbing ejected ink fluid from the recording head.

The recording head may have an electro-thermal conversion element generating thermal energy used for ejection energy to eject ink fluid.

The control means may control the first moving means, the second moving means and the head drive means so as to drive the recording head to eject ink fluid toward the ink receiving means while moving the ink receiving means in a designated direction after moving the recording head from a recording position, and next so as to move the recording head apart from and close to the recording position in a series moving operation when the recording head ejecting ink fluid toward the ink receiving means and concurrently so as to drive the recording head to eject an ink fluid toward the ink receiving means while moving the ink receiving means in a reverse direction against to the designated direction.

A plurality of the recording heads may be formed as a unit defined in a parallel state.

The ink receiving means may have an ink absorber for absorbing ejected ink fluid from the recording head.

The recording head may have an electro-thermal conversion element generating thermal energy used for ejection energy to eject ink fluid.

According to the present invention, at the time of performing the idle ejection operation at the beginning of recording or during recording, the ink receiver is moved along side of the recording heads so as to perform the idle ejection of the ink fluid from the recording head in response to the movement of the ink receiver. Owing to this, it is possible to perform idle ejection of ink fluid during the movements of the recording head unit and the cap unit for the idle ejection operation and to skip a part of these movements. As a result, the time spent performing the idle ejection can be reduced.

The above and other objects, effects, features and advantages of the present invention will become more apparent from the following description of embodiments thereof taken in conjunction with the accompanying drawings.

PREFERRED EMBODIMENTS OF THE PRESENT INVENTION

The invention will now be described with reference to the accompanying drawings.

Figure 1:
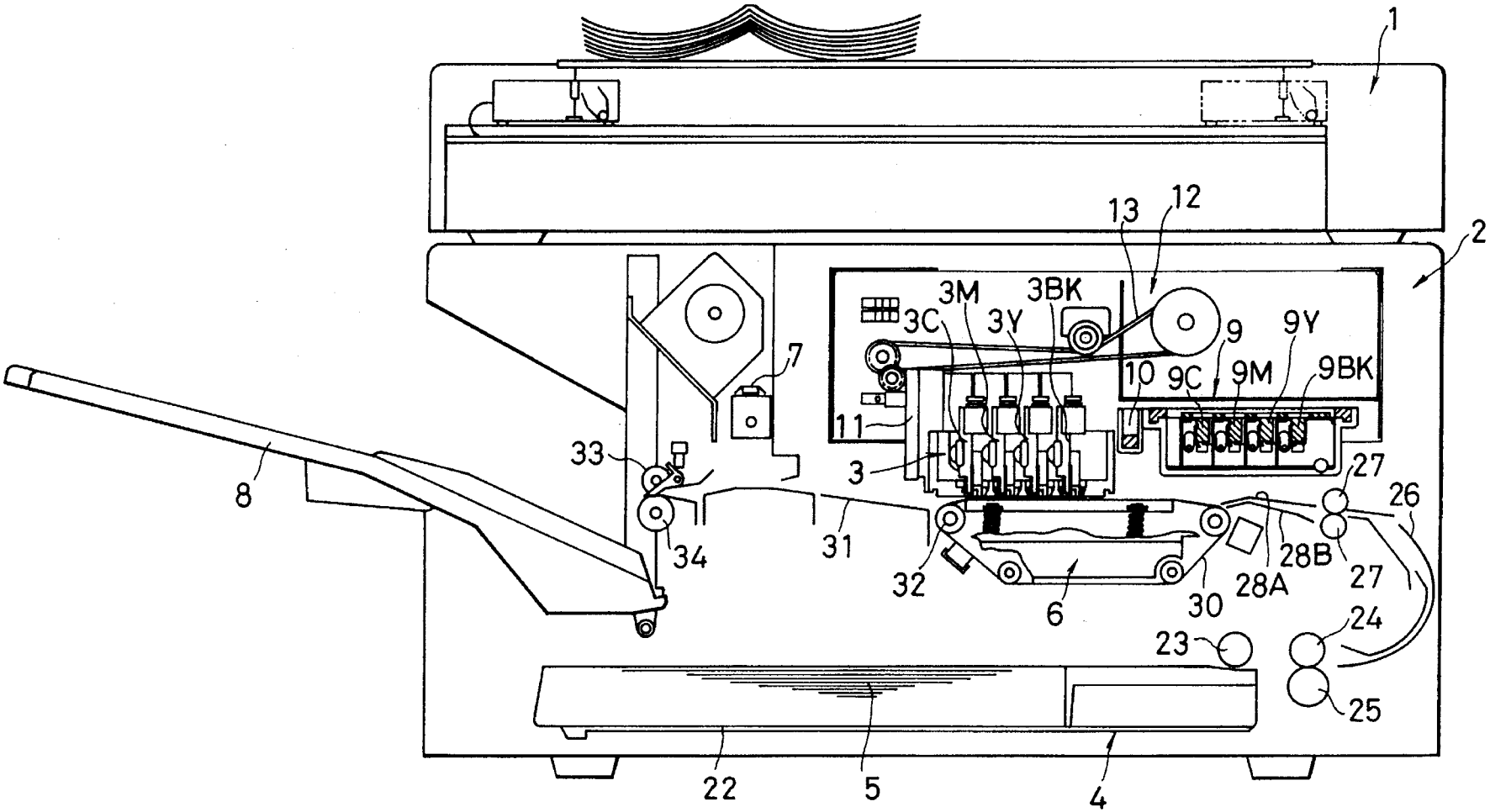
FIG. 1 is a front view of a copying machine using an ink jet recording apparatus of one embodiment of the present invention where a part of its cover is removed.

FIG. 1 shows one embodiment of an ink jet recording apparatus of the present invention. In FIG. 1, component 1 is a scanner part which reads images on an original and converts the images into electric signals. The electric signals are supplied to a recording head unit 3 of a printer part 2 for driving recording heads. Recording sheets 5 serving as a recording medium are stored in a sheet supply part 4, and each of recording sheets is fed toward the belt transport part 6 at a designated timing when performing the recording operation. So far, as the recording sheet 5 moves through the belt transport part 6, recording images are established by ejecting ink fluids from each of the recording heads toward the recording sheet placed at the opposite position to the recording head part 3. The recording sheet on which recording images are developed is extracted through a processing and disposition part 7 and finally reaches a tray 8. Component 9 is a cap unit which moves freely together or separately with an ink receiver 10 used for recovery operations so that the recording head unit 3 may be maintained to be able to record information effectively.

Further, in FIG. 1, the cap unit 9 and the ink receiver 10 are shown in cross section and the recording head unit 10 is shown with a part of its cover wall being removed. The same statements are true for FIGS. 3A–3C and FIGS. 4A–4C.

The recording head unit 3 can be moved by a moving mechanism which will be described below. The recording head unit 3 is formed as an assembled unit composed of four independent recording heads 3C, 3M, 3Y and 3BK, each of which ejects ink fluid corresponding to an individual ink color, cyan(C), magenta (M), yellow (Y) or black (Bk). Each of the recording heads has a plurality of orifices, an ink fluid path connected to each orifice, and an electrothermal conversion element in the each ink fluid path. By supplying pulsed electric signals to an electro-thermal conversion element, a bubble is generated in the ink fluid by thermal energy generated by the element, which lead to ejecting the ink fluid by means of pressure waves generated by the bubble. The body of the recording head unit 3 is supported by the guide 11 so that the recording head unit may be moved freely in the vertical direction in the figure. The recording head unit 3 is moved by the head moving unit 12 composed of belt 13 and a plurality of pulleys and motors.

So far, as described later, in capping operations, the recording head unit 3 is moved upward by the head moving unit 12 at first, and next, the cap unit 9 and the ink receiver 10 connected to the cap unit 9 are moved below the recording head unit 3 by a mechanism shown in FIG. 2, and finally the capping operation is completed. The cap unit 9 is prepared for each of four recording heads mounted in the recording head unit 3, being formed as a set of four cap units, 9C, 9M, 9Y and 9Bk.

The control structure of the above-described copying machine is not shown in FIG. 1. However, the control structure is of a known structure composed of CPU, RAM, ROM and so on. The timing of the movement of the ink receiver 10 and the idle ejection in the present invention to be described later is controlled by the above-mentioned control structure.

Figure 2:
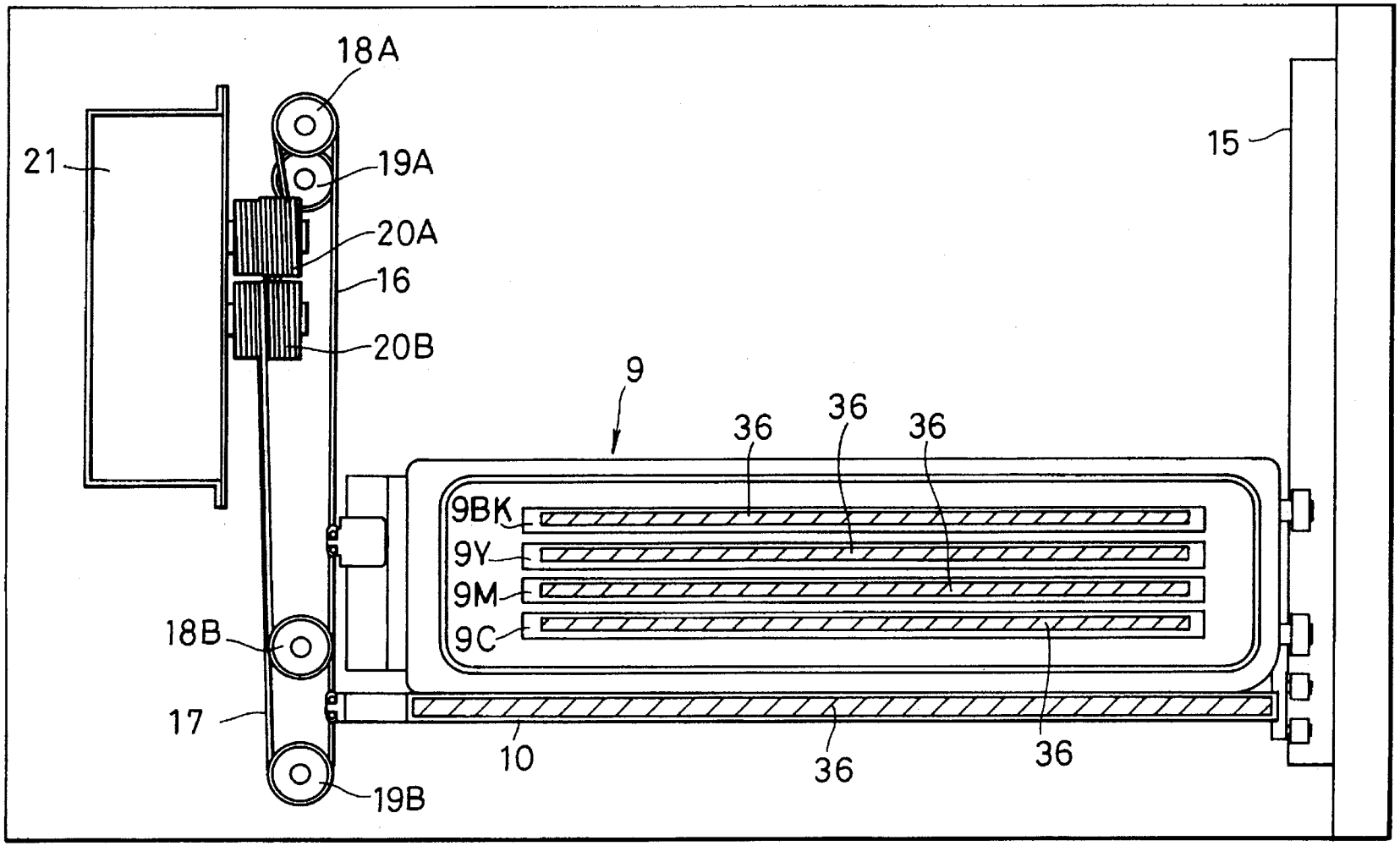
FIG. 2 is a plan view showing a cap unit, an ink receiver and their moving mechanism in the ink jet recording apparatus shown in FIG. 1.

FIG. 2 is a plan view showing the moving mechanism for the cap unit 9 and the ink receiver 10.

One end of the cap unit 9 is supported by the guide rail 15 so that the cap unit 9 may be movable along the guide rail 15. The other end of the cap unit 9 is linked to the drive wire 16 extending parallel to the guide rail 15 between the pulleys 18A and 18B. The ink receiver 10 having an ink absorber 36 inside is placed so as to being extended parallel to the cap unit 9 and its one end is supported by the guide rail 15 so that the ink receiver 10 may be movable, and the other end of the ink receiver 10 is linked with the drive wire 17. The body of the ink receiver 10 is composed of materials such as synthetic resin and its length is greater than the length of the recording heads 3C, 3M, 3Y and 3Bk. The drive wire 17 is extended parallel to the drive wire 16 between the pulleys 19A and 19B. The drive wires 16 and 17 are wound onto the pulleys 20A and 20B respectively, and by driving the pulleys 20A and 20B through clutches connected to the motor 21, the cap unit 9 and the ink receiver 10 can be driven concurrently or separately.

Now referring to FIG. 1, what is described is operational procedures related to recording operations in the copying machine shown in FIGS. 1 and 2. At first, an explanation will be given of operational procedures for recording after the electric power is turned on.

Figure 3A:
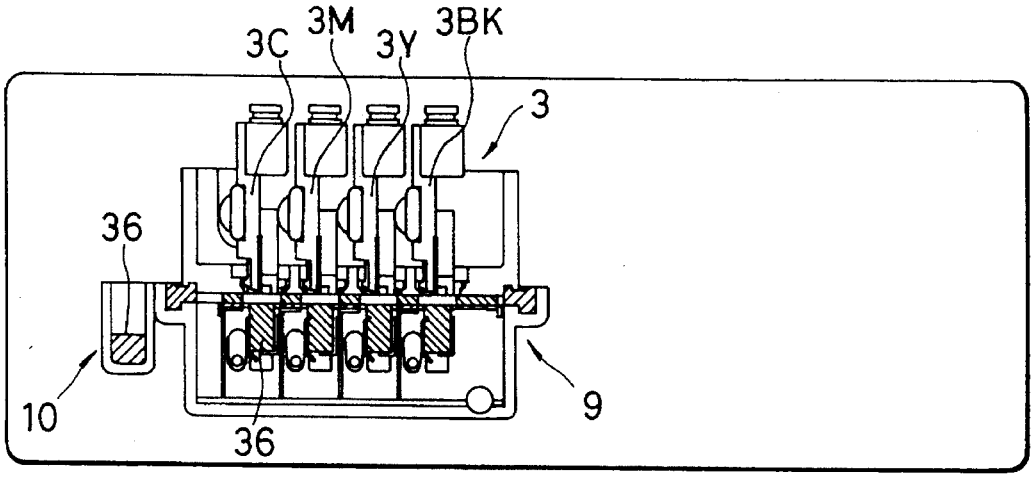
FIGS. 3A, 3B and 3C are front views illustrating a series of movements of a recording head unit, a cap unit and an ink receiver when performing an idle ejection operation in the apparatus shown in FIG. 1.

At first, when the electric power supply to the copying machine is turned on, eject ion recovery procedures are performed by the ink pressurizing and circulating by the recovery pump (not shown) while the recording heads are capped (as shown in FIG. 3A). By above-described ejection recovery procedures, a heavily viscous ink fluid and residual bubbles included in an ink fluid, which are increased in their degree by the passage of a long period of time during which the apparatus has not been operated before the electric power supply is turned on, can be removed from inside the recording head and ejection failures can be prevented. After performing the ejection recovery procedures, the copying machine is ready for recording operations.

The above-mentioned ink pressurizing and circulating operations are not only performed exactly after the electric power supply is turned on but also performed every time when a designated period of time is passed in order to prevent the occurrence of the problems such as heavily viscous ink fluid and residual bubbles included in an ink fluid and so on in case that the operations of the recording head are performed under high temperature and low humidity environments and the viscosity of an ink fluid tends to increase or in case that a long period of time has passed since the power supply to the copying machine was turned on. The above described designated period of time is measured by timers and is called cycle time. In addition, the occurrence of the above described ink pressurizing and circulating operations and the duration time of the operations can be controlled on a time basis and on a second basis, respectively, based on the detected signals from the humidity sensor installed near the recording head unit 3 (not shown). In this control mode, in the case of low humidity, the above defined cycle time can be shortened or the duration time of the ink pressurizing operations can be lengthened. These two parameters can be varies at the same time in order to increase the recovery effect.

After ejection recovery operations by the pressurizing and circulating operations, when a command to start the recording operations is given, a designated number of pulses for inducing ink fluid ejection are supplied to all the electrothermal conversion elements of each recording head so that the ejection operations are performed in order to perform ejection recovery operations just before recording operations. The designated number of pulses for idle ejection operations can be controlled by the detected signals from the humidity sensors in the same manner as that of controlling the ink pressurizing and circulation operations. That is, in the case of lower humidity, the number of pulses for idle ejection operations may be increased. Comparing the effects by the ink pressurizing and circulation operations and the idle ejection operations, the former operations are more effective at preventing of ejection failures. Hence, the time which has passed since the previous ejection recovery operation was performed and after which ink ejection failures due to an increase of the ink fluids and so on cannot be prevented only by the idle ejection operations, is a major factor for determining the cycle time for the ink pressurizing and circulation operations. During the cycle time period between two adjacent recovery operations, the orifice-disposed face of each recording head is capped by the respective cap of the cap unit 9 in order to shield the orifice-disposed faces from atmospheric gases and prevent ink fluids from becoming more viscous to a certain extent, or by idle ejection operations, the ejection recovery operations of the recording heads are performed.

After the ejection recovery operations by the idle ejection operations are performed, in order to start to record information on the recording sheet 5 as shown in FIG. 1, the recording sheet 5 stored in the cassette 22 is extracted by the pickup roller 23, and advanced to the nip part formed between a pair of resist rollers 27, which are not driven by motors yet, through the guide part 26 by the transport rollers 24 and 25. After the front end part of the sheet 5 contacts the nip part, the sheet 5 is further fed by the transport rollers 24 and 25 for a short period of time so that a loop is formed in the sheet 5 inside the guide part 26. This operation is often used for adjusting the resist matching in electro-photo copy machines where the top end resist matching is adjusted and the sheet alignment is corrected.

Next, a pair of resist rollers 27 start to rotate and the sheet 5 is supplied on the transport belt 30 through the guides 28A and 28B. In accordance with the trigger signal to rotate the resist rollers 27, the trigger signals to start scanning images for copying information and the trigger signals to start recording information on the copy sheets by each of recording heads 3C, 3M, 3Y and 3Bk are supplied. So far, the recording sheet 5 moved toward the transport belt 30 is attracted to the surface of the transport belt 30 by electrostatic forces and ink fluids are ejected on the recording sheet 5 moving below the recording heads 3C, 3M, 3Y and 3Bk. And the recording sheet 5 is further moved toward the processing and output unit 7. When the recording sheet 5 is moved from the transport belt 30 to the guide 31, the recording sheet 5 is separated from the transport belt 30 at the belt drive roller 32, the diameter of which is relatively small so that the recording sheet may be easily separated from the transport belt 30 merely by the elastic rebound force developed by the sheet itself.

The diameter of the drive roller 32 is so determined that the displacement of the belt 30 in response to a single rotational movement of the drive roller 32 may be equivalent to the distance between the recording head 3C, located on the left end side of the recording sheet transport path, and the recording head 3Bk, located on the right end side of the recording sheet transport path. This configuration is aimed to prevent the position mismatch of multiple ink images in case that the drive roller 32 rotates on an eccentric axis. Ideally, it is desirable that the drive belt is moved by the distance equivalent to the distance between adjacent array of orifices corresponding to different ink colors in response to a single rotation of the drive roller 32. As the minimum diameter of the drive roller 32 is restricted by the mechanical strength of materials used for the drive roller 32, the actual diameter of the drive roller 32 has to be relatively large enough. In case of driving the drive roller 32 of such relatively large diameter so that the drive belt may be moved by the distance equivalent to the distance between adjacent array of orifices in responsive to a single rotation of the drive roller 32, since the region required for arranging four lines of array of orifices is three times as long as that distance, the apparatus becomes large. For this reason, in this embodiment, the diameter of the drive roller 32 is so determined that the movement of the belt 30 per one rotational movement of the drive roller 32 may be equivalent to the distance between the recording head 3C, located on the left end side of the recording sheet transport path, and the recording head 3Bk, located in the right end side of the recording sheet transport path. The diameter of the drive roller 32 may be also taken to be the distance between the recording head 3C and the recording head 3Y or the distance between the recording heads. The correlation between the diameter of the drive roller 32 and the distance between the recording heads should be established reasonably. As in the above described operations, the recording sheet 5 on which characters and/or images are recorded is moved through the discharge rollers 33 and 34 and finally stacked on the tray 8.

Figure 3B:
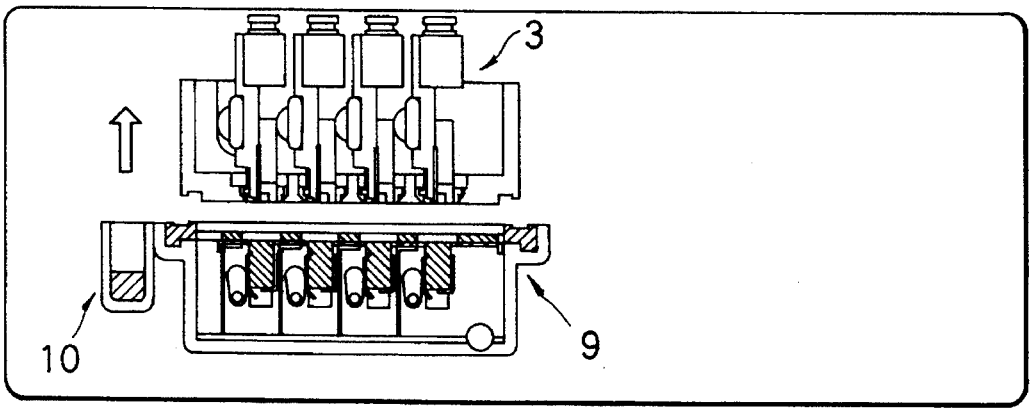
Figure 3C:
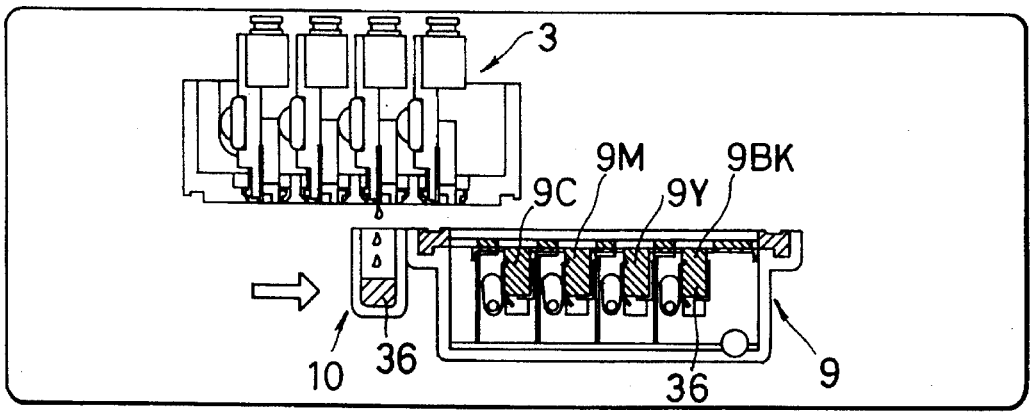

Next, referring to FIGS. 3A, 3B and 3C, idle ejection operation procedures which are mentioned briefly before are now described in detail.

When the trigger signals for starting recording operations are supplied, the recording head unit 3 which is kept in the capping position shown in FIG. 3A is moved upward as shown in FIG. 3B by the head moving unit 12 show in FIG. 1 in order to release the recording head from the capping position. Next, both the cap unit 9 and the ink receiver 10 located to the left side of the cap unit 9 are moved together in the right direction as shown in FIG. 3C. During this movement, when the ink receiver and the cap unit 9 move together along the bottom face of each of recording heads, ink fluids from each of recording heads 3C to 3Bk are ejected by idle ejection operations and the ejected ink fluids are directed to the ink receiver 10. The ejected ink fluids are absorbed and stored in the ink absorber 36 installed inside the ink receiver 10 and which can be composed of porous materials such as sponges. As the ink absorber 36 absorbs ink fluids promptly when ink fluids are ejected, ejected ink fluids are never splashed outside the ink receiver 10 in the apparatus. So far, at the end of idle ejection operations of each of recording heads 3C to 3Bk while the cap unit 9 and the ink receiver 10 are moved aside from the bottom face of each of recording heads, the recording head unit 3 is moved downward to the recording position and the recording operations start.

As described above, in this embodiment, in the idle ejection operations, as the idle ejection operations by the recording head unit 3 are performed at the same time when the cap unit 9 is moved aside from the bottom face of the recording head, the time spent in the idle ejection operations and the movement of the recording head unit 3 and the cap unit 9 for the idle ejection operations is shorter than that in the various prior art apparatus where the idle ejection operations are performed while the cap unit 9 is fixed in relative to the recording head unit 3.

Another example of idle ejection operations can be formed in the following manner. That is, considering a case that ink fluids are not ejected from all of the orifices during recording operations, idle ejection operations are performed every designated time defined by, for example, the timer. In this case, relatively minor ejection failures can be recovered by idle ejection operations, the occurrence of such idle ejection operations coming at relatively short period of time, for example, every few minutes. After a designated number of recording sheets are recorded, the recording head is fixed in the waiting position shown in FIG. 1 where the recording head waits for the next recording information arrival for the rest of the designated time defined by the timer. In case that there is no recording information arriving during this rest of the designated time, the recording head is moved into the capping position shown in FIG. 3A. On the other hand, in case that recording information arrives during this rest of the designated time, the recording head is used for continuing the recording operation. The rest of the designated time is obtained by subtracting the time difference between the end of information recording and the previous ejection operation from the time defined by the timer. In the above case, the actual value of the rest of the designated time is determined to be a little less than the above calculated value because the recording heads wait for information recording operations while their orifices are not covered by caps and ink fluids in the orifices are able to evaporation.

Figure 4A:
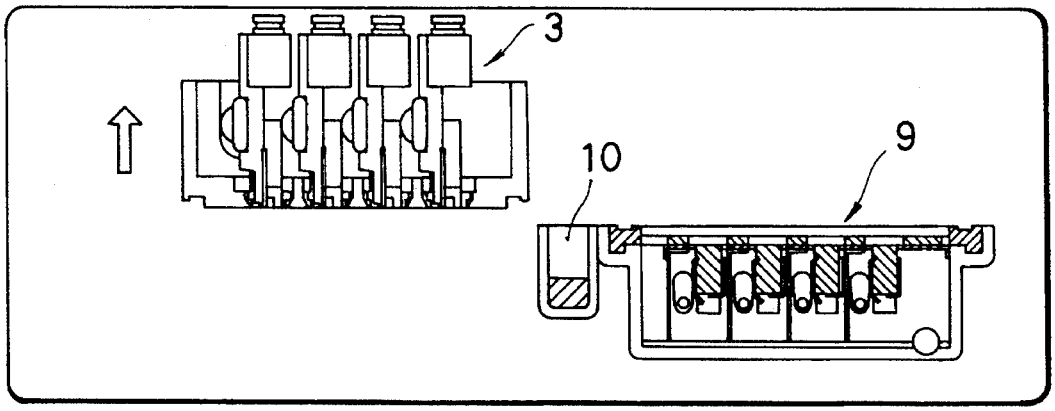
FIGS. 4A, 4B and 4C are front views illustrating a series of movements of an recording head unit, a cap unit and an ink receiver when performing an idle ejection operation in another embodiment of the present invention.
Figure 4B:
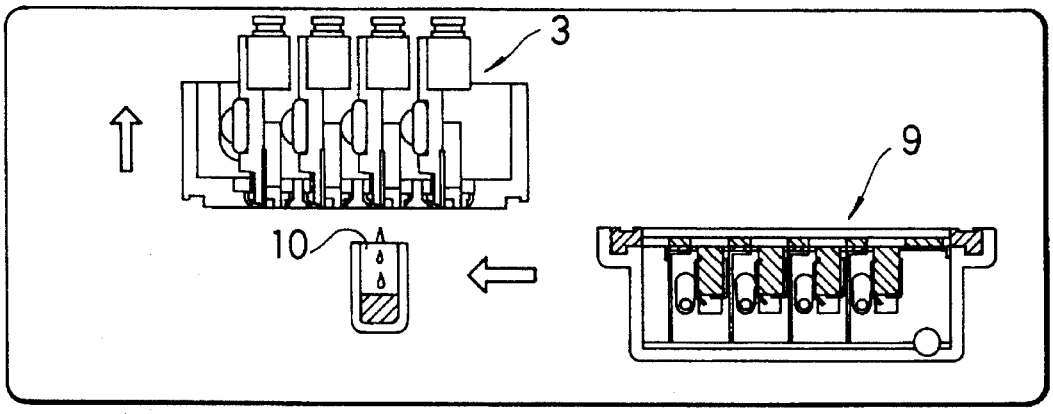
Figure 4C:
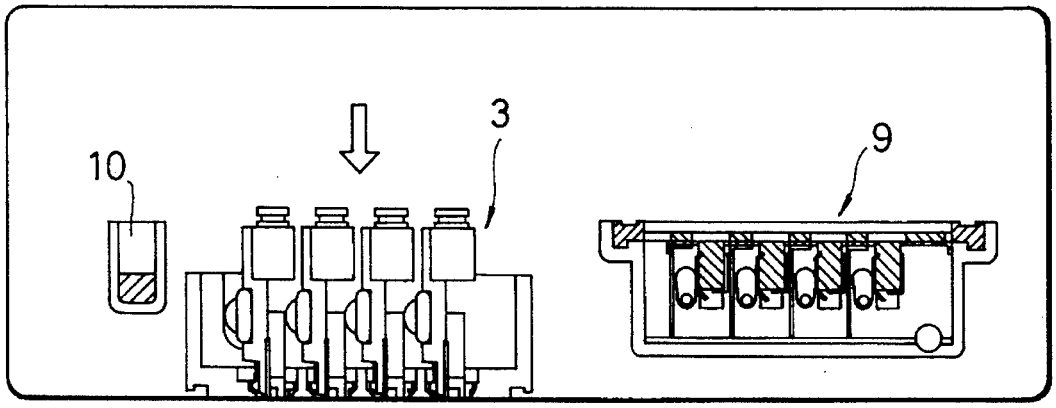

When the above defined timer counts up during the recording operation, the idle ejection operation is performed. Now referring to FIGS. 4A, 4B and 4C, idle ejection operations in this case are described. After the recording head unit 3 is moved upward as shown in FIG. 4A, only the ink receiver 10 is moved below the recording head unit 3, and during this movement, ink fluids are ejected from each of recording heads 3Bk to 3C directed to the ink receiver 10 by idle ejection operations as shown FIG. 4B. In this time, the cap unit 9 is not moved but fixed at the position shown in FIG. 4A. On the other hand, the ink receiver 10 moved to the left side of the recording head is fixed at the left side of the recording head unit 3, and the recording head unit 3 moves down to the recording position and information recording operations start again. After starting information recording operations, in case that idle ejection operations are required, the recording head unit 3 is moved upward and the ink receiver 10 is moved in the right direction from the position shown in FIG. 4C, and in accordance with these movements, idle ejection operations are invoked sequentially from the recording heads 3C to 3Bk. That is, as for idle ejection operations during the information recording operation, the cap unit 9 is not moved but is fixed, and only the ink receiver 10 is moved in a single direction, right or left, and during this movement of the ink receiver 10, idle ejection operations are performed. Therefore, in this embodiment, only by moving the small-sized ink receiver 10 in a single direction, idle ejection operations can be established in a short period of time, and in contrast to the prior art apparatus, where the bi-directional movement of the cap unit in relative to the recording head unit is necessary for performing idle ejection operations. In addition, as the ink absorber 36 can be installed in the ink receiver 10 easily without fixing it by bonding materials or fixing mechanisms, the replacement of the ink absorber 36 can be easily performed by service persons themselves when the ink absorber 36 cannot absorb any more ink fluids.

Though in the above description, what is illustrated is an ink jet recording apparatus having a recording head in which orifices are arranged along its longer side corresponding to the width of the recording sheets to be fed in the apparatus, the application of the present invention is not limited to the above case. The present invention can be applied to an apparatus having a recording head being scanned and moved along the line defined on the recording sheet on which information is recorded. In this case, for example, it may be allowed that, the ink receiver is installed so as to move together with the recording head when the recording head moves to the recording position from the ejection recovery position (the capping position), and that idle ejection operations can be performed during their movement.

The present invention achieves distinct effects when applied to a recording head or a recording apparatus which has means for generating thermal energy such as electrothermal transducers or laser light, and which causes changes in ink by the thermal energy so as to eject ink. This is because such a system can achieve a high density and high resolution recording.

A typical structure and operational principles thereof is disclosed in U.S. Pat. Nos. 4,723,129 and 4,740,796, and it is preferable to use this basic principle to implement such a system. Although this system can be applied either to on-demand type or continuous type ink jet recording systems, it is particularly suitable for the on-demand type apparatus. This is because the on-demand type apparatus has electrothermal transducers, each disposed on a sheet or liquid passage that retains liquid (ink), and operates as follows: first, one or more drive signals are applied to the electrothermal transducers to produce thermal energy corresponding to recording information; second, the thermal energy induces a sudden temperature rise that exceeds the nucleate boiling point so as to cause film boiling on heating portions of the recording head; and third, bubbles are grown in the liquid (ink) corresponding to the drive signals. By using the growth and collapse of the bubbles, the ink is expelled from at least one of the ink ejection orifices of the head to form one or more ink drops. The drive signal in the form of a pulse is preferable because the growth and collapse of the bubbles can be achieved instantaneously and suitably by this form of drive signal. As a drive signal in the form of a pulse, those described in U.S. Pat. Nos. 4,463,359 and 4,345,262 are preferable. In addition, it is preferable that the rate of temperature rise of the heating portions described in U.S. Pat. No. 4,313,124 be adopted to achieve better recording.

U.S. Pat. Nos. 4,558,333 and 4,459,600 disclose the following structure of a recording head, which is incorporated to the present invention: this structure includes heating portions disposed on bent portions in addition to a combination of the ejection orifices, liquid passages and the electrothermal transducers disclosed in the above patents. Moreover, the present invention can be applied to structures disclosed in Japanese Patent Application Laying-open Nos. 123670/1984 and 138461/1984 in order to achieve similar effects. The former discloses a structure in which a slit common to all the electrothermal transducers is used as ejection orifices of the electrothermal transducers, and the latter discloses a structure in which openings for absorbing pressure waves caused by thermal energy are formed corresponding to the ejection orifices. Thus, irrespective of the type of the recording head, the present invention can achieve recording positively and effectively.

The present invention can be also applied to a so-called full-line type recording head whose length equals the maximum length across a recording medium. Such a recording head may consists of a plurality of recording heads combined together, or one integrally arranged recording head.

In addition, the present invention can be applied to various serial type recording heads: a recording head fixed to the main assembly of a recording apparatus; a conveniently replaceable chip type recording head which, when loaded on the main assembly of a recording apparatus, is electrically connected to the main assembly, and is supplied with ink therefrom; and a cartridge type recording head integrally including an ink reservoir.

It is further preferable to add a recovery system, or a preliminary auxiliary system for a recording head as a constituent of the recording apparatus because they serve to make the effect of the present invention more reliable. As examples of the recovery system, there are a capping means and a cleaning means for the recording head, and a pressure or suction means for the recording head. As examples of the preliminary auxiliary system, there are a preliminary heating means utilizing electrothermal transducers or a combination of other heater elements and the electrothermal transducers, and a means for carrying out preliminary ejection of ink independently of the ejection for recording. These systems are effective for reliable recording.

The number and type of recording heads to be mounted on a recording apparatus can be also changed. For example, only one recording head corresponding to a single color ink, or a plurality of recording heads corresponding to a plurality of inks different in color or concentration can be used. In other words, the present invention can be effectively applied to an apparatus having at least one of the monochromatic, multi-color and full-color modes. Here, the monochromatic mode performs recording by using only one major color such as black. The multi-color mode carries out recording by using different color inks, and the full-color mode performs recording by color mixing.

Furthermore, although the above-described embodiments use liquid ink, inks that are liquid when the recording signal is applied can be used: for example, inks can be employed that solidify at a temperature lower than room temperature and are softened or liquefied in the room temperature. This is because in the ink jet system, the ink is generally temperature adjusted in a range of 30° C.–70° C. so that the viscosity of the ink is maintained at such a value that the ink can be ejected reliably.

In addition, the present invention can be applied to such apparatus where the ink is liquefied just before the ejection by the thermal energy as follows so that the ink is expelled from the orifices in the liquid state, and then begins to solidify on hitting the recording medium, thereby preventing the ink evaporation: the ink is transformed from solid to liquid state by positively utilizing the thermal energy which would otherwise cause the temperature rise; or the ink, which is dry when left in air, is liquefied in response to the thermal energy of the recording signal. In such cases, the ink may be retained in recesses or through holes formed in a porous sheet as liquid or solid substances so that the ink faces the electrothermal transducers as described in Japanese Patent Application Laying-open Nos. 56847/1979 or 71260/1985. The present invention is most effective when it uses the film boiling phenomenon to expel the ink.

Furthermore, the ink jet recording apparatus of the present invention can be employed not only as an image output terminal of an information processing device such as a computer, but also as an output device of a copying machine including a reader, and as an output device of a facsimile apparatus having a transmitting and receiving function, and as an output device of an optical disc apparatus for recording an/or reproducing information onto and/or from an optical disc. These apparatus requires means for outputting processed information in the form of hard copy.

Figure 5:
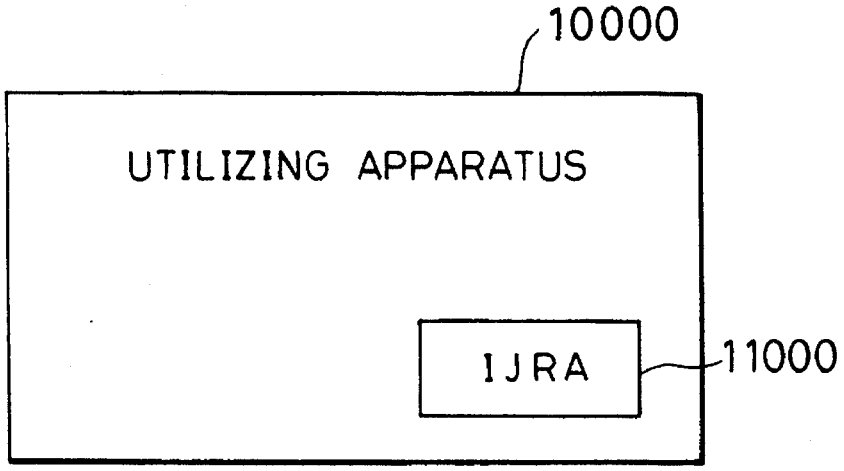
FIG. 5 is a schematic diagram illustrating an embodiment of an apparatus to which the ink jet recording apparatus in accordance with the present invention is equipped.

FIG. 5 schematically illustrates one embodiment of a utilizing apparatus in accordance with the present invention to which the ink jet recording system shown in FIG. 1 is equipped as an out put means for outputting processed information.

In FIG. 5, reference numeral 10000 schematically denotes a utilizing apparatus which can be a work station, a personal or host computer, a word processor, a copying machine, a facsimile machine or an optical disc apparatus. Reference numeral 11000 denotes the ink jet recording apparatus (IJRA) shown in FIG. 1. The ink jet recording apparatus (IJRA) 11000 receives processed information form the utilizing apparatus 10000 and provides a print output as hard copy under the control of the utilizing apparatus 10000.

Figure 6:
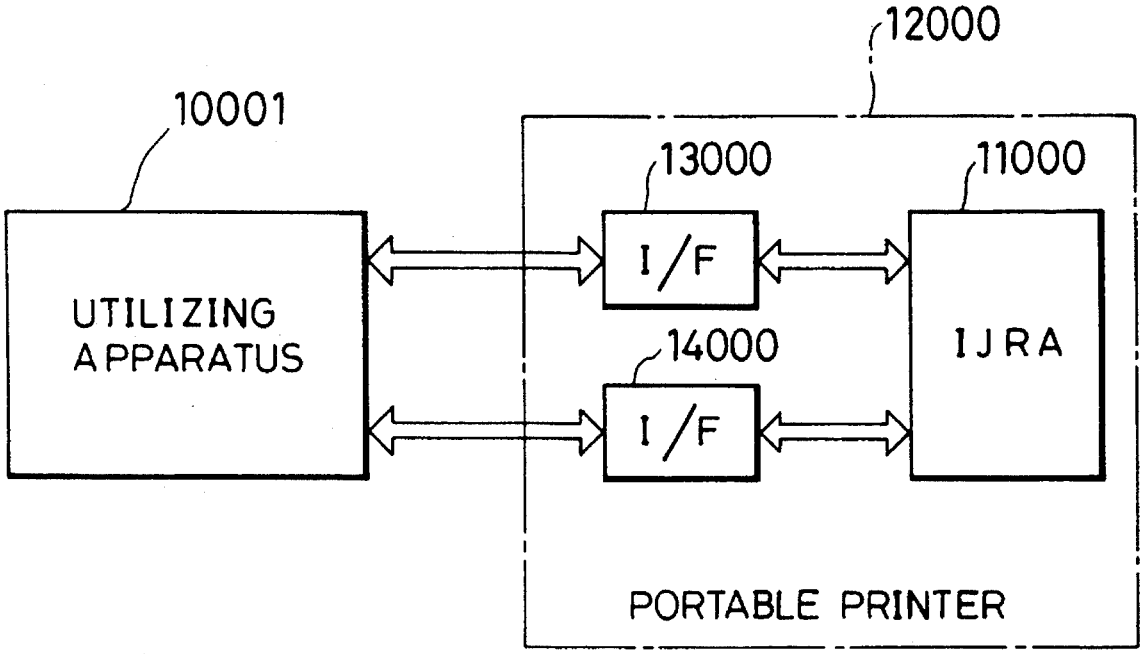
FIG. 6 is a schematic drawing illustrating an embodiment of a portable printer in accordance with the present invent ion.

FIG. 6 schematically illustrates another embodiment of a portable printer in accordance with the present invention to which a utilizing apparatus such as a work station, a personal or host computer, a word processor, a copying machine, a facsimile machine or an optical disc apparatus can be coupled.

In FIG. 6, reference numeral 10001 schematically denotes such a utilizing apparatus. Reference numeral 12000 schematically denotes a portable printer having the ink jet recording apparatus (IJRA) 11000 shown in FIG. 1 is incorporated thereinto and interface circuits 13000 and 14000 receiving information processed by the utilizing apparatus 11001 and various controlling data for controlling the ink jet recording apparatus 11000, including hand shake and interruption control from the utilizing apparatus 11001. Such control per se is realized by conventional printer control technology.

The present invention has been described in detail with respect to various embodiments, and it will now be apparent from the foregoing to those skilled in the art that changes and modifications may be made without departing from the invention in its broader aspects, and it is the intention, therefore, in the appended claims to cover all such changes and modifications as fall within the true spirit of the invention.

What is claimed is:

1. An ink jet recording apparatus for recording information by ejecting an ink fluid onto a recording medium, comprising:

a recording head having an orifice for ejecting said ink fluid from said orifice:

head moving means for moving said recording head apart from and close to said recording position;

a head drive means for driving said recording head to eject said ink fluid;

a capping means for capping said orifice of said recording head, said capping means being installed so as to be able to move relative to said recording head;

a first moving means for relatively moving said capping means and said recording head;

an ink receiving means for receiving said ink fluid ejected from said recording head;

a second moving means for moving said ink receiving means and said recording head and for enabling this movement to be independent of movement which is due to said first transport means; and a control means for controlling said first moving means, said second moving means and said head drive means so as to permit said recording head to eject said ink fluid toward said ink receiving means while there is relative movement between said recording head, said capping means and said ink receiving means, wherein said control means controls said first moving means, said second moving means and said head drive means so as to drive said recording head to eject said ink fluid toward said ink receiving means while moving said ink receiving means in a designated direction after moving said recording head from a recording position, and next so as to move said recording head apart from and close to said recording position in a series moving operation when said recording head ejecting said ink fluid toward said ink receiving means and concurrently so as to drive said recording head to eject said ink fluid toward said ink receiving means while moving said ink receiving means in a direction which is opposite to said designated direction.

2. An ink jet recording apparatus as claimed in claim 1, further comprising a plurality of said recording heads, wherein said recording heads are formed as a unit in which said recording heads are oriented in a parallel manner.

3. An ink jet recording apparatus as claimed in claim 2, wherein said ink receiving means comprises an ink absorber which absorbs said ink fluid that has been objected from said recording head.

4. An ink jet recording apparatus as claimed in claim 3, wherein said recording head comprises an electrothermal conversion element for generating thermal energy that provides ejection energy to eject said ink fluid.

5. An ink jet apparatus for use with an ink jet head having an opening for discharging ink, said apparatus comprising:

a capping means for capping said opening;

a cap moving means for moving said capping means relative to said ink jet head;

an ink receiving means for receiving ink discharged from said opening;

a receiver moving means for moving said ink receiving means relative to said ink jet head; and a means for selectively operating said cap moving means and said receiver moving means in a first movement in which said ink receiving means moves together with said capping means and in a second movement in which said ink receiving means moves separately from said capping means according to a condition of said apparatus for varying a distance between said ink receiving means and said capping means.

6. An ink jet apparatus according to claim 5, wherein said first movement in which said ink receiving means moves together with said capping means is selected in response to a signal for starting a recording operation.

7. An ink jet apparatus according to claim 5, wherein said second movement in which said ink receiving means moves separately from said capping means is selected at predetermined intervals during a recording operation.

8. An ink jet apparatus for use with an ink jet head having a plurality of openings disposed in an array along a range corresponding to a width of a recording sheet fed to said apparatus, said apparatus comprising:

a capping means for capping said opening;

a cap moving means for moving said capping means relative to said ink jet head;

an ink receiving means for receiving ink discharged from said opening, said ink receiving means comprising a body having a length, wherein the length of said body is larger than said range along which said plurality of openings are disposed in said array;

a receiver moving means for moving said ink receiving means relative to said ink jet head; and a means for selectively moving said cap moving means and said receiver moving means in a first movement in which said ink receiving means moves together with said capping means and in a second movement in which said ink receiving means moves separately from said capping means according to a condition of said apparatus.

9. An ink jet apparatus according to claim 8, further comprising a plurality of said ink jet heads, wherein said ink jet heads are formed as a unit in which said recording heads are oriented in a parallel manner.

10. An ink jet apparatus according to claim 9, wherein said ink receiving means comprises an ink absorber which absorbs said discharged ink fluid that has been ejected from said ink jet head.

11. An ink jet apparatus according to claim 10, wherein said ink jet head comprises an electrothermal conversion element for generating thermal energy that provides discharging energy for discharging said ink.

12. An ink jet apparatus for use with an ink jet head having an opening for discharging ink, said apparatus comprising:

a capping means for capping said opening;

a cap moving means for moving said capping means relative to said ink jet head;

an ink receiving means for receiving ink discharged from said opening;

a receiver moving means for moving said ink receiving means relative to said ink jet head; and a means for selectively moving said cap moving means and said receiver moving means in a first movement in which said ink receiving means moves together with said capping means and in a second movement in which said ink receiving means moves separately from said capping means according to a condition of said apparatus, wherein said ink jet head discharges said ink toward said ink receiving means while there is relative movement between said ink jet head, said capping means and said ink receiving means.

13. An ink jet recovery process used in an ink jet apparatus with an ink head having an opening for discharging an ink, which has a capping means for capping said opening; a cap moving means for moving said capping means relative to said ink jet head; an ink receiving means for receiving said ink discharged from said opening; and a receiver moving means for moving said ink receiving means relative to said ink jet head, wherein said cap moving means and said receiver moving means are selectively operable in a first movement in which said ink receiving means moves together with said capping means and in a second movement in which said ink receiving means moves separately from said capping means according to a condition of said apparatus for varying a distance between said ink receiving means and said capping means; said process comprising the steps of:

selecting said first movement;

moving said capping means and said ink receiving means together from a state such that said opening of said ink jet head is covered by said capping means;

driving said ink jet head to discharge said ink toward said ink receiving means during said moving; and moving said ink jet head to a recording position.

14. An ink jet recovery process used in an ink jet apparatus with an ink jet head having an opening for discharging an ink, which has a capping means for capping said opening; a cap moving means for moving said capping means relative to said ink jet head; an ink receiving means for receiving ink discharged from said opening; and a receiver moving means for moving said ink receiving means relative to said ink jet head, wherein said cap moving means and said receiver moving means are selectively operable in a first movement in which said ink receiving means moves together with said capping means and in a second movement in which said ink receiving means moves separately from said capping means according to a condition of said apparatus for varying a distance between said ink receiving means and said capping means; said process comprising the steps of:

selecting said second movement;

moving said ink jet head from a recording position;

moving said ink receiving means while said ink receiving means faces said opening of said ink jet head which is moving from said recording position; and driving said ink jet head to discharge said ink toward said ink receiving means facing said opening.

* * * * *

UNITED STATES PATENT AND TRADEMARK OFFICE

CERTIFICATE OF CORRECTION

PATENT NO. : 5,483,267

DATED : January 9, 1996

INVENTOR(S) : Masaharu Nemura et al.

It is certified that error appears in the above-identified patent and that said Letters Patent is hereby corrected as shown below:

COLUMN 2

Line 27, "are" should read --is--.
Line 35, "fluids" should read --fluid--.

COLUMN 3

Line 44, "in" should be deleted.
Line 48, "in" should be deleted.

COLUMN 4

Line 16, "to" should be deleted.
Line 53, "of an" should read --of a --.
Line 60, "invent" should read --invent- --.

COLUMN 5

Line 21, "unit 10" should read --unit 3--.
Line 36, "lead" should read --leads--.

COLUMN 6

Line 18, "eject ion" should read --ejection--.
Line 51, "varies" should read --varied--.

UNITED STATES PATENT AND TRADEMARK OFFICE

CERTIFICATE OF CORRECTION

PATENT NO. : 5,483,267

DATED : January 9, 1996

INVENTOR(S) : Masaharu Nemura et al.

It is certified that error appears in the above-identified patent and that said Letters Patent is hereby corrected as shown below:

COLUMN 7

Line 2, "of" should be deleted.

COLUMN 8

Line 1, "responsive" should read --response--.
Line 25, "show" should read --shown--.
Line 54, "in" should be deleted.
Line 64, "at" should read --at a--.

COLUMN 9

Line 15, "able" should read --subject--.
Line 46, "in" should be deleted.

COLUMN 10

Line 57, "consists" should read --consist--.

COLUMN 11

Line 59, "an/or" should read --and/or--.
Line 60, "requires" should read --require--.
Line 66, "out put" should read --output--.

UNITED STATES PATENT AND TRADEMARK OFFICE

CERTIFICATE OF CORRECTION

PATENT NO. : 5,483,267

DATED : January 9, 1996

INVENTOR(S) : Masaharu Nemura et al.

It is certified that error appears in the above-identified patent and that said Letters Patent is hereby corrected as shown below:

COLUMN 12

Line 6, "form" should read --from--.

COLUMN 13

Line 17, "objected" should read --ejected--.

COLUMN 14

Line 37, "ink" should read --ink jet--.

Signed and Sealed this

Ninth Day of July, 1996

Bruce Lehman

*Attest:*

BRUCE LEHMAN

*Attesting Officer*

*Commissioner of Patents and Trademarks*